US009056510B2

(12) United States Patent
Nagao et al.

(10) Patent No.: US 9,056,510 B2
(45) Date of Patent: Jun. 16, 2015

(54) IMAGE FORMING APPARATUS

(75) Inventors: Shinichi Nagao, Tokyo (JP); Shinji Morita, Japan (JP)

(73) Assignee: KONICA MINOLTA BUSINESS TECHNOLOGIES, INC., Tokyo (JP)

( * ) Notice: Subject to any disclaimer, the term of this patent is extended or adjusted under 35 U.S.C. 154(b) by 358 days.

(21) Appl. No.: 13/609,385

(22) Filed: Sep. 11, 2012

(65) Prior Publication Data

US 2013/0093824 A1 Apr. 18, 2013

(30) Foreign Application Priority Data

Oct. 12, 2011 (JP) ..... 2011-225150

(51) Int. Cl.

| | |
|---|---|
| ***B41J 2/45*** | (2006.01) |
| ***B41J 25/308*** | (2006.01) |
| ***G03G 15/043*** | (2006.01) |
| ***G03G 21/16*** | (2006.01) |

(52) U.S. Cl.

CPC ..... *B41J 25/3088* (2013.01); *B41J 25/3082* (2013.01); *B41J 2/45* (2013.01); *G03G 15/043* (2013.01); *G03G 21/1666* (2013.01)

(58) Field of Classification Search

CPC ..... B41J 2/45; B41J 25/3082; B41J 25/3088
USPC ..... 347/138, 152, 263
See application file for complete search history.

(56) References Cited

U.S. PATENT DOCUMENTS

2011/0050836 A1* 3/2011 Masuda ..... 347/224

FOREIGN PATENT DOCUMENTS

| | | |
|---|---|---|
| JP | 03-125112 | 5/1991 |
| JP | 09-080876 | 3/1997 |
| JP | 09-159954 | 6/1997 |
| JP | 09-230662 | 9/1997 |
| JP | 2003-066305 | 3/2003 |

OTHER PUBLICATIONS

Japanese Office Action, Notification of Reason for Refusal, Application No. 2011-225150, dispatch date: Jul. 23, 2013 (3 pages).

English translation of Japanese Office Action, Notification of Reason for Refusal, Application No. 2011-225150, dispatch date: Jul. 23, 2013 (3 pages).

Chinese Office Action, The First Office Action, Application No. or Patent No. 201210378083.9, Issuing Date: Oct. 29, 2014 and English translation thereof (total of 16 pages).

* cited by examiner

*Primary Examiner* — Justin Seo
*Assistant Examiner* — Kendrick Liu
(74) *Attorney, Agent, or Firm* — Lucas & Mercanti, LLP

(57) ABSTRACT

An image forming apparatus A includes: a light irradiation device 3 which irradiates laser light; an image carrying body 1 which is exposed to the laser light to form a latent image on the exposed portion; and an abutting member 31 which is fastened to the light irradiation device in abutting contact with a stationary member F for defining a reference position. The abutting member 31 changes in volume due to temperature fluctuation, and the light irradiation device 3 moves with respect to the stationary member F, in an opposite direction to a focal point shift which has taken place along an irradiation direction of the laser light due to the temperature fluctuation.

4 Claims, 4 Drawing Sheets

IMAGE FORMING APPARATUS

CROSS-REFERENCE TO RELATED APPLICATION

This application is based on Japanese Patent Application No. 2011-225150 filed on Oct. 12, 2012, the contents of which are incorporated herein by reference.

BACKGROUND

1. Technical Field

The present invention relates to an image forming apparatus.

2. Description of Related Arts

An image forming apparatus using the electrophotographic method forms an image based on image information by exposing an image carrier such as a photoreceptor drum to laser light Alight irradiation device is provided with a laser diode or the like serving as a light source of the laser light, as well as a collimator lens, a fθ lens, and so forth. A light irradiation device irradiates laser light onto a photoreceptor drum through such components. A Light irradiation device forms a latent image corresponding to image information on a photoreceptor drum by exposing photoreceptor drum, which includes photosensitive materials on its surface, to the laser light.

A distance from a photoreceptor drum to a light irradiation device is adjusted so that a focal position of the laser light does not move, and then the light irradiation device is fixed to a partition wall or the like in an image forming apparatus. However, structural components of a light irradiation device are subject to volume change such as thermal expansion, due to heat from laser light and temperature fluctuation in an environment, whereby a focal point of the laser light for exposure of the photoreceptor drum may be shifted in location. Therefore, a problem arises due to difficulty in accurately focusing on a photoreceptor drum to form an image, and hence forming an image with superior quality.

A technique using a supporting member which supports a fθ lens is proposed for the purpose of correcting a shifted focal point due to temperature rise of the fθ lens (See Japanese Patent Application Publication No, H09-159954, for example). According to this technique, a supporting member is also thermally-expanded so that it can correct a shifted focal point due to temperature rise of a fθ lens. The expanded supporting member can adjust to thermal expansion of the fθ lens, thereby preventing degradation of image precision.

According to the technique disclosed in Japanese Patent Application Publication No. H09-159954, position variation of an imaging surface due to temperature rise of a fθ lens may be corrected, but temperature fluctuation of other components of a light irradiation device is not taken into consideration whatsoever. In other words, this technique can only achieve correction of a shifted focal point of laser light due to temperature fluctuation of a fθ lens. Considering that a shifted focal point of laser light can be caused by temperature fluctuation of a fθ lens as well as various other components, this technique can hardly correct a shifted focal point of laser light which results from combined position variation in a light irradiation apparatus as a whole.

The present invention is intended to address the above-described problems and to provide an image forming apparatus which is capable of correcting a shifted focal point of laser light generated by a light irradiation device as a whole, due to volume change of each component associated with temperature fluctuation.

SUMMARY

In order to achieve at least one of the aforementioned objectives, an image forming apparatus, reflecting one aspect of the present invention, includes: a light irradiation device which irradiates laser light; an image carrying body which is exposed to the laser light to form a latent image on the exposed portion; and an abutting member which is fastened to the light irradiation device in abutting contact with a stationary member for defining a reference position. The abutting member changes in volume due to temperature fluctuation, and the light irradiation device moves with respect to said stationary member, in an opposite direction to a focal point shift which has taken place along an irradiation direction of the laser light due to the temperature fluctuation.

Preferably, a coefficient of thermal expansion of the abutting member is equal to or more than $7.0\times10^{-5}/°$ C.

Preferably, the abutting member is made of resin.

Preferably, the image forming apparatus further includes a pressing member which is located on an opposite side of the light irradiation device to the abutting member, to push the light irradiation device toward the abutting member.

Preferably, the abutting member is located between a partition wall for separating the image carrying body and the light irradiation device, and the light irradiation unit, using the partition wall as the stationary member, when a focal point of the laser light is shifted in a direction away from the light irradiation device due to temperature rise.

Preferably, the abutting member is located between a wall section placed on an opposite side of the image carrying body to the light irradiation device, and the light irradiation unit, using the wall section as the stationary member, when a focal point of the laser light is shifted in a direction toward the light irradiation unit due to temperature rise.

The objects, features, and characteristics of this invention other than those set forth above will become apparent from the description given herein below with reference to preferred embodiments illustrated in the accompanying drawings.

DETAILED DESCRIPTION

The embodiments of this invention will be described below with reference to the accompanying drawings. Nonetheless, the following descriptions do not limit the technical scope of the appended claims or the meaning of terms described therein.

Figure 1:
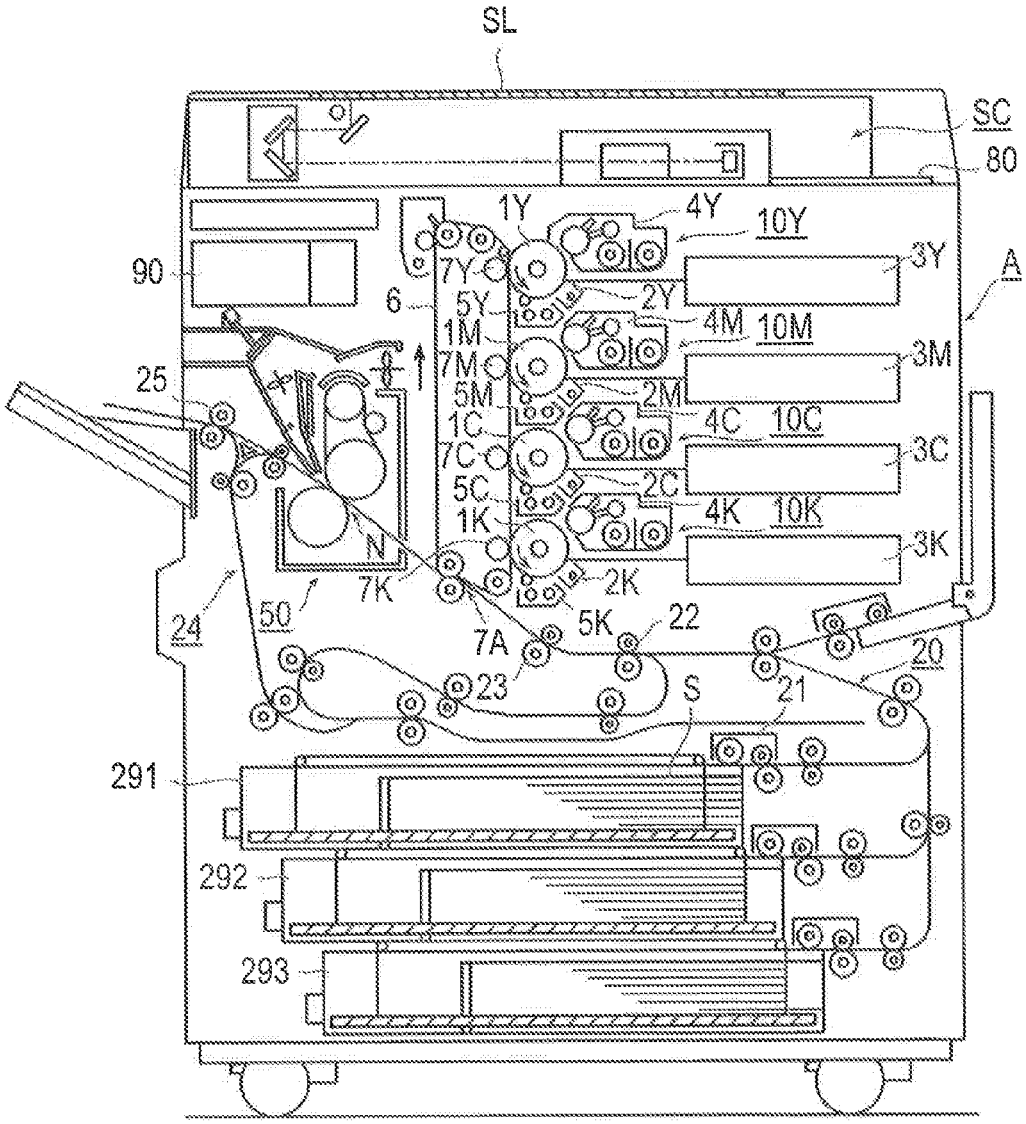
FIG. 1 is a cross-sectional view schematically illustrating a structure of an image forming apparatus according to an embodiment of the present invention.

FIG. 1 is a cross-sectional view schematically illustrating a structure of an image forming apparatus according to an embodiment of the present invention.

An image forming apparatus A illustrated in FIG. 1 is also called a tandem-type color image forming apparatus, and it forms a color image using four sets of image forming units. The image forming apparatus A forms an image onto a sheet of paper such as printing paper, using an imaging process according to the electrophotographic method.

The image forming apparatus A forms a color image using four sets of image forming units. The four sets of image forming units are composed of an image forming unit 10Y for forming an image in Yellow (Y); an image forming unit 10M for forming an image in Magenta (M); an image forming unit 10C for forming an image in Cyan (C); and an image forming unit 10K for forming an image in Black (K).

The image forming unit 10Y includes a photoreceptor drum 1Y as an image carrying body, a charging unit 2Y arranged around the photoreceptor drum, a light irradiation device 3Y, a developing device 4Y and a cleaning device 5Y. Likewise, the image forming unit 10M includes a photoreceptor drum 1M as an image carrying body, a charging unit 2M arranged around the photoreceptor drum, a light irradiation device 3M, a developing device 4M and a c leaning device 5M. The image forming unit 10C includes a photoreceptor drum 1C as an image carrying body, a charging unit 2C arranged around the photoreceptor drum, a light irradiation device 3C, a developing device 4C and a cleaning device 5C. The image forming unit 10K includes a photoreceptor drum 1K as an image carrying body, a charging unit 2K arranged around the photoreceptor drum, a light irradiation device 3K, a developing device 4K and a cleaning device 5K. The photoreceptor drums 1Y, 1M, 1C and 1K, the charging units 2Y, 2M, 2C and 2K, the light irradiation devices 3Y, 3M, 3C and 3K, and the cleaning devices 5Y, 5M, 5C and 5K of the image forming units 10Y, 10M, 10C and 10K have similar functions, respectively. Therefore, in the following descriptions, the symbols Y, M, C and K are omitted except for the case where any of the image forming units is distinguished from the others.

The photoreceptor drum 1 is exposed to laser light to form a latent image on its exposed portion. Specifically, the photoreceptor drum 1 as an image carrying body includes on its metal substrate surface, a photosensitive element made of resin such as polycarbonate containing organic photo conductors (OPC), and forms a latent image on the exposed portion to an optical beam such as laser light. The photoreceptor drum 1 rotates in a perpendicular direction (i.e. vertical scanning direction) to a scanning direction of the laser light (i.e. main scanning direction), by means of a drum motor (not shown). The main scanning direction is parallel to a rotation axis of the photoreceptor drum 1.

The light irradiation device 3 includes a polygon mirror, a fθ lens and so forth. The light irradiation device 3 scans the photoreceptor drum along the main scanning direction while condensing the laser light, and then concentrates the laser light on the photoreceptor drum 1 rotating in the vertical scanning direction to form a latent image thereon. The light irradiation device 3 is pressed onto a fixed partition wall inside the image forming apparatus A through an abutting member, so that the distance to the photoreceptor drum 1 will be kept constant. The details are described below with reference to FIG. 2, FIG. 3A and FIG. 3B.

An intermediate transferring belt 6 is an endless belt. The intermediate transferring belt 6 is supported and driven by a plurality of rollers including the primary transferring roller 7 for rotating the intermediate transferring belt. The latent image in each color developed by the image forming unit 10 on the photoreceptor drum 1 is primarily transferred to the intermediate transferring belt 6 which is supported and driven by the primary transferring roller 7, and the toner image composed of the color images in layers Y, M, C, K) is formed on the intermediate transferring belt 6.

A paper transporting unit 20 transports a sheet of paper S. The paper transporting unit 20 feeds the paper S accommodated in paper feeding trays 291, 292 and 293 by means of a first paper feeding unit 21, and then transports the paper to a secondary transferring unit 7A through a pair of loop formation rollers 22 as well as a pair of resist rollers 23. The color image formed on the intermediate transferring belt 6 is secondarily transferred to the paper S in the secondary transferring unit 7A.

The following is a description of the electrophotographic process executed by the image forming apparatus A for forming an image on the paper S.

Firstly, when a document is set on a platen with a slit SL, an optical system of the image reading device SC scans and exposes the document image on the platen. Linear image sensors read reflected light from the document image through a mirror, and perform photoelectric conversion. Image information signals for respective colors generated by the photoelectric conversion undergo analog process, A/D conversion, shading compensation and image-compression process by an image processing section (not shown). After that, these image information signals are input into the light irradiation device 3 of the image forming unit 10 for respective colors.

The light irradiation device 3 exposes the photoreceptor drum 1 to the laser light based on the image information signals corresponding to the document image, in order to form a latent image on the photoreceptor drum 1. Specifically, the surface of the photoreceptor drum 1 is charged with ions generated by the charging unit 2, which is provided with Scorotron-type corona discharge electrodes, for example, and the light irradiation device 3 scans and exposes the surface of the charged photoreceptor drum 1. The electric potential of the exposed portion of the photoreceptor drum 1 is lowered, and the electrostatic latent image corresponding to the document image is formed on the photoreceptor drum 1. The developing device 4 develops the electrostatic latent image on the photoreceptor drum 1 by means of electrostatic forces, in order to form a toner image in respective colors.

The fixing device 50 applies heat and pressure to the paper S with the toner images transferred thereon at a nip portion N, and melts the toner to fix the toner images onto the paper S. Subsequently, the discharging roller 25 discharges the paper S to the outside of the apparatus.

Each of the above-described units of the image forming apparatus A is connected with a control unit 90 and controlled by the control unit 90 accordingly. The image forming apparatus A may include any other components than those described above while it may also be deprived of any of the components.

Next, with reference to FIG. 2, FIG. 3A and FIG. 3B, a structure of the light irradiation apparatus according to the present embodiment will be described in detail.

Figure 2:
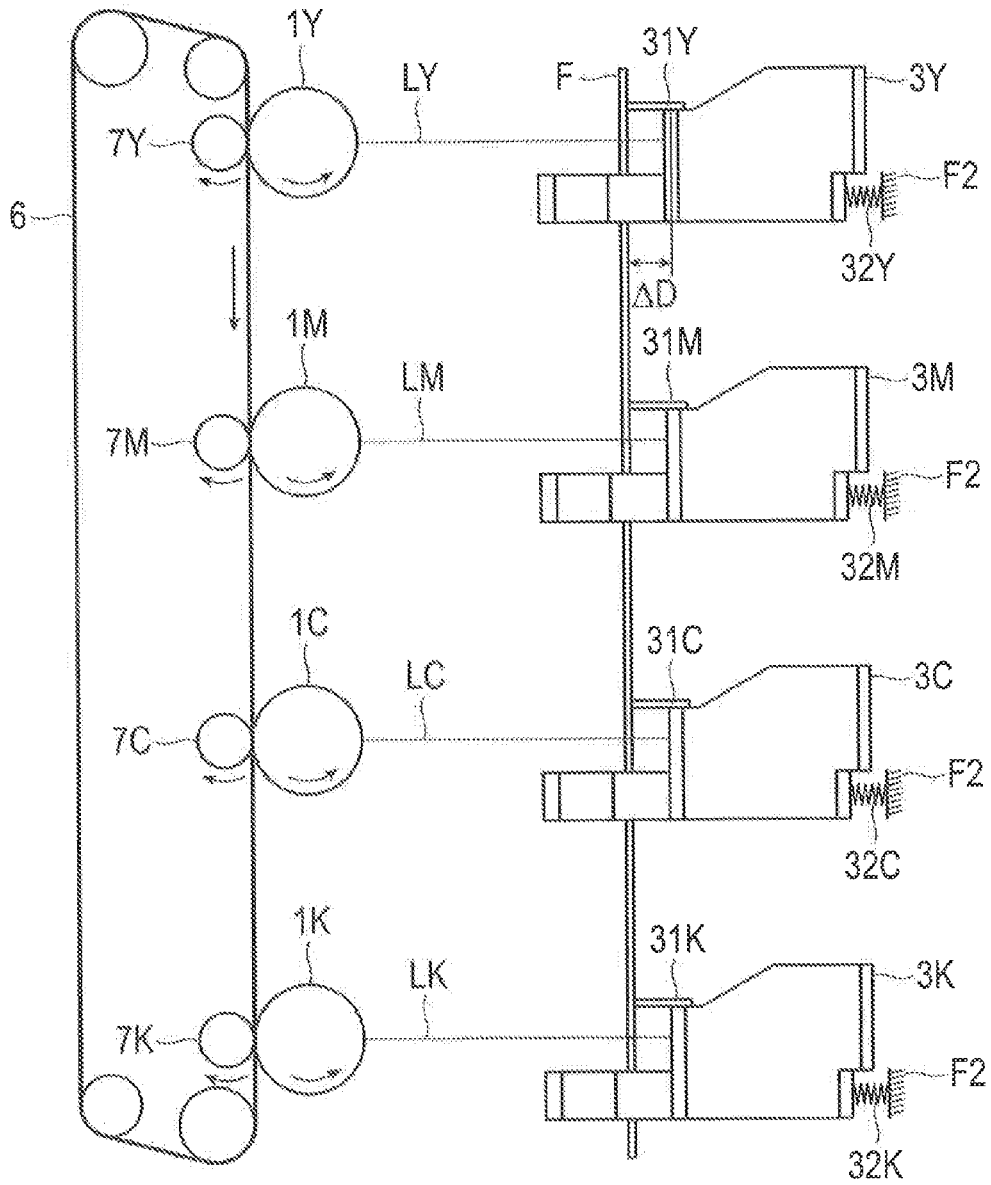
FIG. 2 is a schematic view illustrating a part of an image forming unit and a primary transfer unit according to an embodiment of the present invention.
Figure 3A:
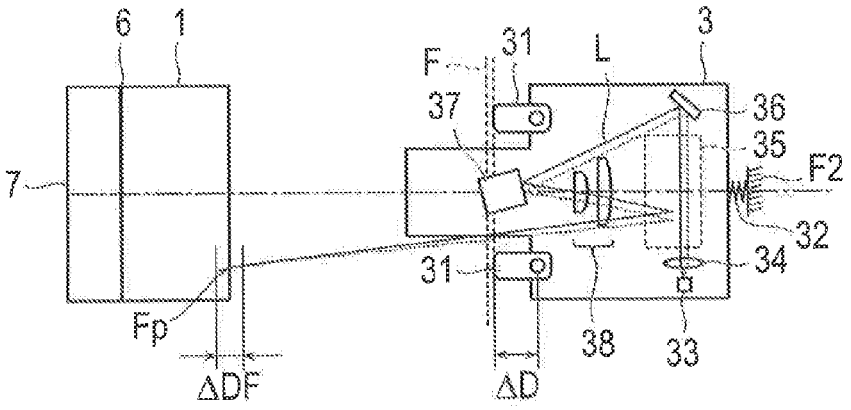
FIG. 3A and FIG. 3B are a transverse cross-sectional view and a horizontal cross-sectional view respectively, and each of them schematically illustrates an internal structure of a light irradiation device according to an embodiment of the present invention.
Figure 3B:
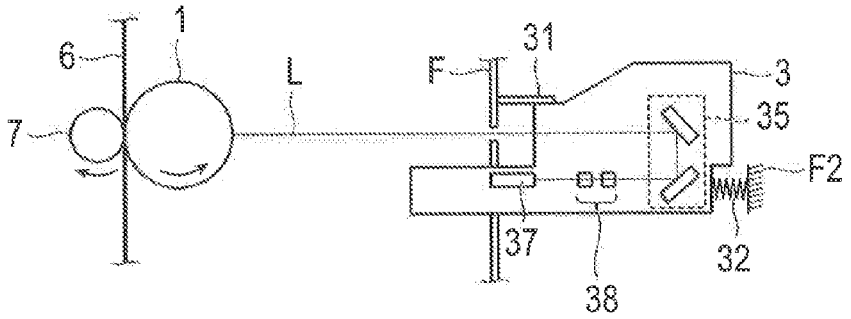

FIG. 2 is a schematic view illustrating a part of the image forming unit and the primary transferring unit according to the present embodiment, and FIG. 3A and FIG. 3B are a transverse cross-sectional view and a horizontal cross-sectional view schematically illustrating an internal structure of the light irradiation apparatus according to the present embodiment, respectively.

As illustrated in FIG. 2, the light irradiation device 3 for each of Y, M, C and K colors is arranged in a separated location by a predetermined distance from the photoreceptor drum 1 for each of Y, M, C and K colors. The light irradiation device 3 irradiates laser light L to the photoreceptor drum 1 based on the image information signals. The laser light L is concentrated on the photoreceptor drum 1 to form a focal point $F_p$. The light irradiation device 3 includes an abutting member 31 and a pressing member 32, and it is positioned by a partition wall F.

The partition wall F separates an area near the primary transferring unit which contains the photoreceptor drum 1 and the intermediate transferring belt 6 (hereinafter, referred to as front-side area), and an area near the image forming unit 10 which contains the light irradiation device 3 (hereinafter, referred to as back-side area). The partition wall F is formed a part of inner walls of the image forming apparatus A, for example, so that the position of the partition wall F will remain unchanged. Therefore, the partition wall F serves as a stationary member for defining a reference position of the light irradiation device 3.

In the present embodiment, the abutting member 31 is fastened to the image forming unit in the front-side area of the light irradiation device 3 in abutting contact with the partition wall F. By adjusting the location where the abutting member 31 is fastened to the light irradiation device 3 in the course of shipment preparations or the like, it becomes possible to adjust an effective length ΔD to the partition wall F. By adjusting the effective length. ΔD in advance, the focal point of the laser light L is brought precisely to the surface of the photoreceptor drum 1. While the effective length ΔD cannot be made larger than a certain limit due to necessity for apparatus miniaturization, it ranges between 15 mm and 45 mm for example. The abutting member 31 is made of a material with a coefficient of thermal expansion (i.e. coefficient of linear expansion) greater than $7.0\times10^{-5}/°$ C. such as resin including polycarbonate, polypropylene and poly butylene terephthalate. Furthermore, various materials can be mixed to create a material with a desired coefficient of thermal expansion.

The pressing member 32 is an elastic body which push the light irradiation device 3 from the opposite side to the abutting member 31. The pressing member 32 is a metallic spring in abutting contact with a wall section F2 such as the inner wall of the image forming apparatus A, for example.

The present embodiment assumes that the focal point of the laser light L is shifted away from the light irradiation device 3 along the irradiation direction of the laser light L, due to temperature rise in the components of the light irradiation device 3 and so forth. Along with the temperature rise, the abutting member 31 is thermally-expanded so that the light irradiation device 3 is pushed toward the back-side area. Since the light irradiation device 3 itself is moved toward the back-side area, the focal point of the laser light L is also moved closer to the light irradiation device 3. In this manner, the shifted focal point due to temperature rise of each component can be corrected properly. In the meantime, the pressing member 32 pushes the light irradiation device 3 in a direction opposite to the movement of the light irradiation device as it is compressed elastically. Therefore, the pressing member 32 can keep a stable posture of the light irradiation device 3, thereby avoiding an optical axis of the laser light L from being inclined.

A working example will be described together with an internal structure of the light irradiation device.

FIG. 3A and FIG. 3B are cross-sectional views, each schematically illustrating an internal structure of the light irradiation device according to the present embodiment. As illustrated in FIG. 3A, a light source 33 such as a laser diode emits laser light L based on the image information signals. A collimator lens 34 adjusts the laser light L from the light source 33 in order to produce a parallel beam. The laser light L of a parallel beams arrives at a reflective mirror 36 through an interior space of a return mirror unit 35 to be reflected to a polygon mirror 37.

The rotating polygon mirror 37 deflects the laser light. L so that the laser light L will pass through the fθ lens 38. The rotating polygon mirror 37 causes the laser light L to travel in the main scanning direction.

The fθ lens 38 condenses the laser light L deflected by the polygon mirror 37 so that the focal point $F_p$ will be formed on the surface of the photoreceptor drum 1. The laser light L condensed by the fθ lens hence creates an imaging surface on the photoreceptor drum 1 as it is deflected by the polygon mirror 37 to scan the photoreceptor drum 1.

As illustrated in FIG. 3B, the laser light. L which has passed through the fθ lens 38 is reflected by a mirror in a lower position among those arranged in different heights in the return mirror unit 35. After that, the laser light L is reflected by a mirror in an upper position before reaching the photoreceptor drum 1.

The light irradiation device 3 with such optical elements as illustrated in FIG. 3A and FIG. 3B is subject to temperature fluctuation due to heat from the laser light L and so forth. Because of this temperature fluctuation, the focal point $F_p$ of the laser light L may be shifted toward the front-side or back-side area within a range ΔDF, for example. The major factors for the shifting focal point $F_p$ include change in optical characteristics caused by the temperature fluctuation of the optical elements of the light irradiation device 3 (e.g. change in an imaging surface shape, a refraction index, etc.), position variation of the thermally-expanded optical elements from their design situation, and so forth. Although shift amount of the focal point due to these factors differs from device to device in accordance with degree of temperature fluctuation and so forth, this shift amount is too large to disregard image degradation due to the shifted focal point $F_p$ (typically, 0.05 mm or larger).

Table 1 shows various factors for the shifted focal point associated with temperature rise of the optical elements as well as respective simulation results of the shift amount, in the case where temperature has risen by 20° C. in the light irradiation device 3. Table 1 illustrates the shift amount of focal point due to optical characteristic change of the collimator lens 34, the distance change between the collimator lens 34 and the light source 33, the shift amount of a light source block (i.e. a combined unit of the light source 33 and the collimator lens 34) from its design situation due to temperature fluctuation, and the shift amount of the focal point due to optical characteristic change of the fθ lens 38. Table 1 herein defines any shift amount of the focal point in a traveling direction of the laser light L as a positive (+) value, and any shift amount in the opposite direction as a negative (−) value.

TABLE 1

| Factor for shifted focal point | Shift amount (mm) |
|---|---|
| Optical characteristic change of the collimator lens | +1.29 |
| Distance change between the collimator lens and the light source | −1.15 |
| Shift amount of the light source block from its design situation due to the temperature fluctuation | +0.14 |

TABLE 1-continued

| Factor for shifted focal point | Shift amount (mm) |
|---|---|
| Optical characteristic change of the fθ lens | −0.06 |
| Total | +0.08 |

According to the data for the light irradiation device 3 exemplified in Table 1, the shift amount of the focal point due to the temperature fluctuation in various optical elements turns out to be +0.008 mm in total, indicating that the focal point has been shifted by 0.08 mm toward the front-side area. Therefore, proper correction of the shifted focal point would require movement of the light irradiation device 3 in the negative direction, namely, in the direction toward the back-side area of the light irradiation device 3 (i.e. rightward in FIG. 3A and FIG. 3B).

This example uses, as a material for the abutting member 31, polycarbonate with a coefficient of thermal expansion being $7.0\times10^{-5}$/° C., and sets the effective length ΔD at 40 mm. The linear expansion amount ΔL of the abutting member 31 can be calculated by Formula (1) shown below in the case where the temperature fluctuation amount is 20° C.

$$\Delta L = \rho \times \Delta T \times \Delta T \quad (1)$$

$$\Delta L = (7.0\times10^{-5}/^\circ\text{ C.})\times(40\text{ mm})\times(20^\circ\text{ C.}) \approx 0.06\text{ mm}$$

(ρ: coefficient of thermal expansion, ΔT: temperature fluctuation amount)

Since the abutting member 31 is located in the front-side area of the light irradiation device 3, namely, between the partition wall F and the light irradiation apparatus 3, the abutting member 31 moves the light irradiation device 3 by 0.06 mm toward the back-side area as it expands linearly by 0.06 mm due to the 20° C. temperature rise. Therefore, the expanded abutting member 31 can achieve correction of the shifted focal point by 0.06 mm while the focal point would remain shifted by 0.08 mm in the direction away from the light irradiation device 3 without the abutting member 31.

Table 2 shows calculation results of the linear expansion amount from Formula (1) in the case where SUS (stainless steel) and Al (aluminum) are used as a material for the abutting member 31, under the identical conditions (i.e. the temperature fluctuation is 20° C., and the effective length is 40 mm)

TABLE 2

| Material | Coefficient of thermal expansion (/° C.) | Linear expansion amount (mm) |
|---|---|---|
| SUS | $1.7\times10^{-5}$ | +0.01 |
| Al | $2.4\times10^{-5}$ | +0.02 |

As illustrated in Table 2, shifted focal point can only be corrected by 0.01 mm when SUS is used as a material for the abutting member 31, and by 0.02 mm when Al is used. Therefore, as illustrated in Table 1, in the case where a shift amount of the focal position measures as much as +0.08 mm in the entire light irradiation device 3, metallic materials such as SUS and Al with lower thermal expansion coefficients lower than that of resin are not considered suitable for the abutting member 31.

The above-described embodiment and example suggest that a material for the abutting member 31 and an effective length ΔD should be determined in consideration of the shift amount of the focal point due to the temperature fluctuation of each component of the light irradiation device 3. The above-described embodiment and example ensures accurate correction of the shifted focal point by means of a simple structure with the abutting member 31 being located between the light irradiation device 3 and the partition wall F, even if there is a large shift amount of the focal point of the light irradiation device 3.

The present invention is not necessarily limited to the embodiment described above, and various modifications can be achieved within the scope of the appended claims.

Figure 4:
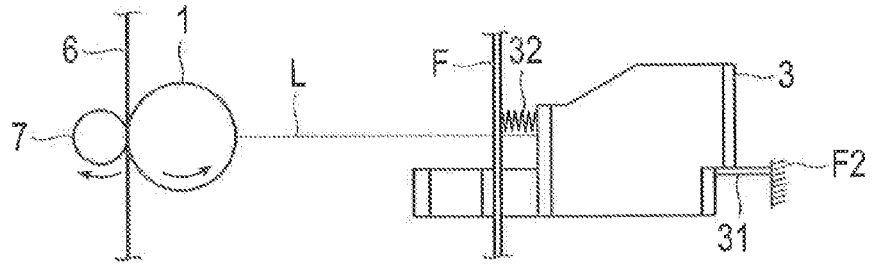
FIG. 4 is a schematic view illustrating another arrangement of an abutting member according to an embodiment of the present invention.

For example, the above-described embodiment refers to a structure for correcting the shifted focal point of the light irradiation device 3 in the direction toward the front-side area due to the temperature change. However, the light irradiation device 3 may also be subject to the shifted focal point in the direction toward the back-side area due to the temperature change. In the latter case, the abutting member 31 is located closer to the back side of the light irradiation device 3, namely, between the light irradiation device 3 and the wall section F2, as illustrated in FIG. 4. The wall section F2 is located on the opposite side of the light irradiation device 3 to the photoreceptor drum 1, and its position is unchanged regardless of any temperature change, and its position can be used as a reference position. The pressing member 32 is located between the partition wall F and the light irradiation device 3. This structure ensures a movement of the entire light irradiation device 3 toward the front-side area by means of the thermally-expanded abutting member 31 even when the focal point of the laser light L is shifted toward the back-side area due to the temperature fluctuation of the light irradiation device 3. Therefore, this embodiment ensures movement of the shifted focal point in the direction toward the front-side area, thereby achieving proper correction of the shifted focal point due to the temperature fluctuation.

Figure 5:
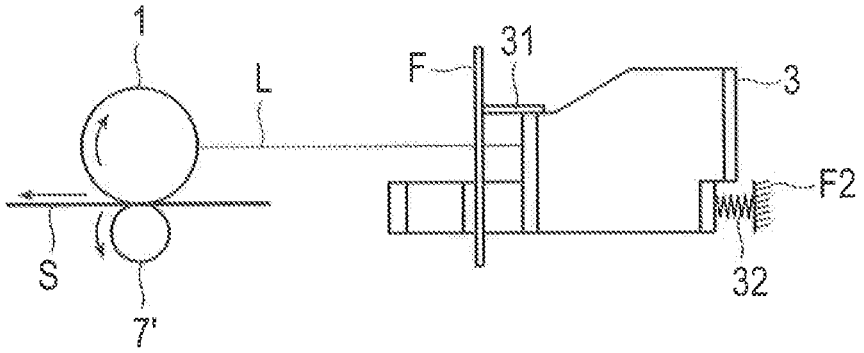
FIG. 5 is a schematic view illustrating part of a primary transferring unit according to another embodiment of the present invention.

The above-described embodiment also refers to the image transferring process starting with the primary transferring step for transferring the developed latent image (i.e. toner image) on the photoreceptor drum 1 to the intermediate transferring belt 6, to be follows by the secondary-transferring step for transferring the tosser image to the paper S by the secondary transferring unit 7A. However, the image transferring process is not limited to that procedure. As illustrated in FIG. 5, the toner image on the photoreceptor drum 1 can also be transferred to the paper S directly, in the absence of the intermediate transferring belt 6. In the latter case, the roller 7' configured so as to face the photoreceptor drum 1 functions as a supporting roller.

In the above-described embodiments, the partition wall F and the wall section F2 are used as stationary members for abutting contact of the abutting member 31. However, the stationary members are not limited to those examples. Namely, any structural member of the image forming apparatus A can be used as the stationary members, unless it is subject to any environmental change involving temperature fluctuation.

Moreover, dimensions of the abutting member 31 can be optimized for maximizing the effects of the above-described embodiment. For example, its dimensions are 20×60 mm in size, and 2-3 mm in thickness.

What is claimed is:

1. An image forming apparatus comprising:

a light irradiation device which irradiates laser light;

an image carrying body which is exposed to said laser light to form a latent image on the exposed portion; and an abutting member which is fastened to said light irradiation device in abutting contact with a stationary member for defining a reference position, wherein said abutting member changes in volume due to temperature fluctuation, and said light irradiation device moves with respect to said stationary member, in an opposite direction to a focal point shift which has taken place along an irradiation direction of said laser light due to said temperature fluctuation, and wherein said abutting member is located between a partition wall for separating said image carrying body and said light irradiation device, and said irradiation device, using said partition wall as said stationary member, when a focal point of said laser light is shifted in a direction away from said light irradiation device due to temperature rise.

2. The image forming apparatus as claimed in claim 1, wherein a coefficient of thermal expansion of said abutting member is equal to or more than $7.0\times10^{-5}/°$ C.

3. The image forming apparatus as claimed in claim 1, wherein said abutting member is made of resin.

4. The image forming apparatus as claimed in claim 1, further comprising:

a pressing member which is located on an opposite side of said light irradiation device to said abutting member, to push said light irradiation device toward said abutting member.

* * * * *